United States Patent [19]

Hoegh

[11] Patent Number: 4,855,699

[45] Date of Patent: Aug. 8, 1989

[54] SELF-CUTOFF FOR LATCHING COAXIAL SWITCHES

[75] Inventor: Poul E. Hoegh, San Jose, Calif.

[73] Assignee: Teledyne Microwave, Mountain View, Calif.

[21] Appl. No.: 166,861

[22] Filed: Mar. 11, 1988

[51] Int. Cl.[4] ..... H01H 9/00

[52] U.S. Cl. ..... 335/177; 335/181

[58] Field of Search ..... 335/177, 178, 179, 180, 335/181, 182, 185, 186, 187

[56] References Cited

U.S. PATENT DOCUMENTS 2,521,171 9/1950 Kercher ..... 335/177

3,001,049 9/1961 Didier ..... 335/182

4,366,459 12/1982 Vitola ..... 335/179

4,747,010 5/1988 Bayer ..... 335/181

*Primary Examiner*—E. A. Goldberg

*Assistant Examiner*—Lincoln Donovan

*Attorney, Agent, or Firm*—Skjerven, Morrill, MacPherson, Franklin & Friel

[57] ABSTRACT

A switching mechanism actuated into first and second positions by application of current through appropriate respective electromagnets includes a switch structure which insures that current is cut off to the actuating electromagnet upon switching having taken place to a chosen state.

11 Claims, 4 Drawing Sheets

SELF-CUTOFF FOR LATCHING COAXIAL SWITCHES

BACKGROUND OF THE INVENTION

1. Field of the Invention

This invention relates to switching mechanisms, and more particularly, to a switching mechanism which utilizes electromagnets for switching purposes.

2. Description of the Prior Art

In a typical prior art coaxial switching mechanism 8, (FIG. 1), as manufactured by Teledyne Microwave, Inc., a switch body 10 includes a lower body portion 12, an upper body portion 16 fixed to the lower body portion 12, and a cap 13 fixed to the lower body portion 12 and defining a cavity 14 within which the upper body portion 16 is positioned. Mounted to the upper body portion 16 are electromagnets 18, 20, the electromagnet 18 including an iron core 22 within a coil 24, and the electromagnet 20 similarly including an iron core 26 within a coil 28. An iron plate 30 is fixed to the body 16, and the portion 30A of the iron plate 30 connects the top portions 22A, 26A of the cores 22, 26. A permanent magnet 32 is connected to the iron plate 30 between the coils 24, 28, this permanent magnet 32 having, for example, the north pole thereof in contact with the plate 30 to induce a north pole in the plate 30.

The upper body portion 16 defines an internal cavity 34 into which respective portions 22B, 26B of the cores 22, 26 extend. Pivotally mounted to the body portion 16 within that cavity 34 is a soft iron rocker 36 that is pivoted at its center directly below the lower magnet pole (in this embodiment the south pole) of the permanent magnet 32.

With the south pole of the permanent magnet 32 adjacent the rocker 36, a continuing south pole is induced in the rocker 36.

The rocker 36 is movable to a first position, shown in FIG. 1, whereby an end portion 36B thereof is adjacent and in contact with the portion 26B of the core, while the other end portion 36A thereof is removed from the end portion 22B of the core 22. The rocker 36 is movable to a second position wherein the end portion 36B is removed from the end portion 26B of the core 26, while the end portion 36A is brought adjacent to and into contact with the end portion 22B of the core 22.

With the rocker 36 in its first position (FIG. 1), a portion 38A of actuator spring mechanism 38 fixed to the rocker 36 acts on a dielectric rod 40 which in turn urges a conductive reed 42 (against the force of a spring 44) into contact with conductors 46, 48. Meanwhile, the spring mechanism portion 38B is removed from the dielectric rod 50 in association with the other conductive reed 52, so that reed 52 is moved by spring 54 to result in electrical connection not being provided between the conductors 48, 56.

With the rocker 36 in its second position, the spring mechanism portion 38B causes the reed 52 to be moved to provide electrical connection between the conductors 48, 56, while the reed 42 is removed from conducting between the conductors 46, 48.

If, for example, current is applied to the coil 28 to induce a north pole at the portion 26A of the core 26 and a south pole at the portion 26B thereof adjacent the rocker 36, the north pole of the core 26 and the north pole of the plate portion 30A will supplement each other (no current flowing through the coil 24 of the electromagnet 18), to produce a strong north pole at the portion 22B of the core 22. Thus, there will be a strong attracting force between the end portion 36A (south pole) of the rocker 36 and the portion 22B (north pole) of the core 22, while there will be a repelling force between the end portion 36B (south pole) of the rocket 36 and the end portion 26B (south pole) of the core 26. This provides a moment of rotation applied to the rocker 36, and as it moves from its first toward its second position, the spring 44 moves the reed 42 out of contact with the conductors 46, 48, while the spring mechanism portion 38B moves the reed 52 against the force of the spring 54 into contact with the conductors 48, 56.

To switch back to the original position (shown in FIG. 1), current is cut off from the coil 28 of the electromagnet 20 and current is applied to the coil 24 of the electromagnet 18 to provide the reverse action.

Achievement of such switching requires only a momentary current pulse on an appropriate coil to complete each switching operation. However, heretofore, current has remained on at the coil last activated, until it is applied to activate the other coil, whereupon current is cut off from the first coil.

An activated coil is therefore subject to being heated up as long as the current remains therethrough, whereby the resistance of that coil may be increased to the stage where the voltage and current available are no longer able to provide sufficient magnetic force to perform the switching operation when required. This detrimental heat condition is increased by operating the switching mechanism in a hot environment, as is often required.

SUMMARY OF THE INVENTION

It is accordingly an object of this invention to provide a switching mechanism of the type described that will automatically cut off current to the coil of the electromagnet to which it is applied, immediately after the switching operation has been accomplished.

It is a further object of this invention to provide a switching mechanism which, while fulfilling the above object, ensures that the cut-off of current occurs sufficiently late in the switching cycle to ensure that the proper switching takes place.

Broadly stated, the invention is in a switching mechanism having a body and first and second electromagnets mounted to the body, to each of which current can be applied and from each of which current can be cut off. A movable member is movably mounted to the body, movable to a first position determining a first switching mechanism state upon application of current to the first electromagnet, and movable to a second position determining a second switching mechanism state upon application of current to the second electromagnet. The improvement comprises means for providing that current is cut off from the first electromagnet upon the movable member being moved from its second position toward its first position sufficiently to determine that the movable member will adopt its first position, and for providing that current is cut off from the second electromagnet upon the movable member being moved from its first toward its second position sufficiently to determine that the movable member will adopt its second position.

BRIEF DESCRIPTION OF THE DRAWINGS

Other objects of the invention will become apparent from a study of the following specification and drawings, in which.

DESCRIPTION OF THE PREFERRED EMBODIMENT

Figure 1:
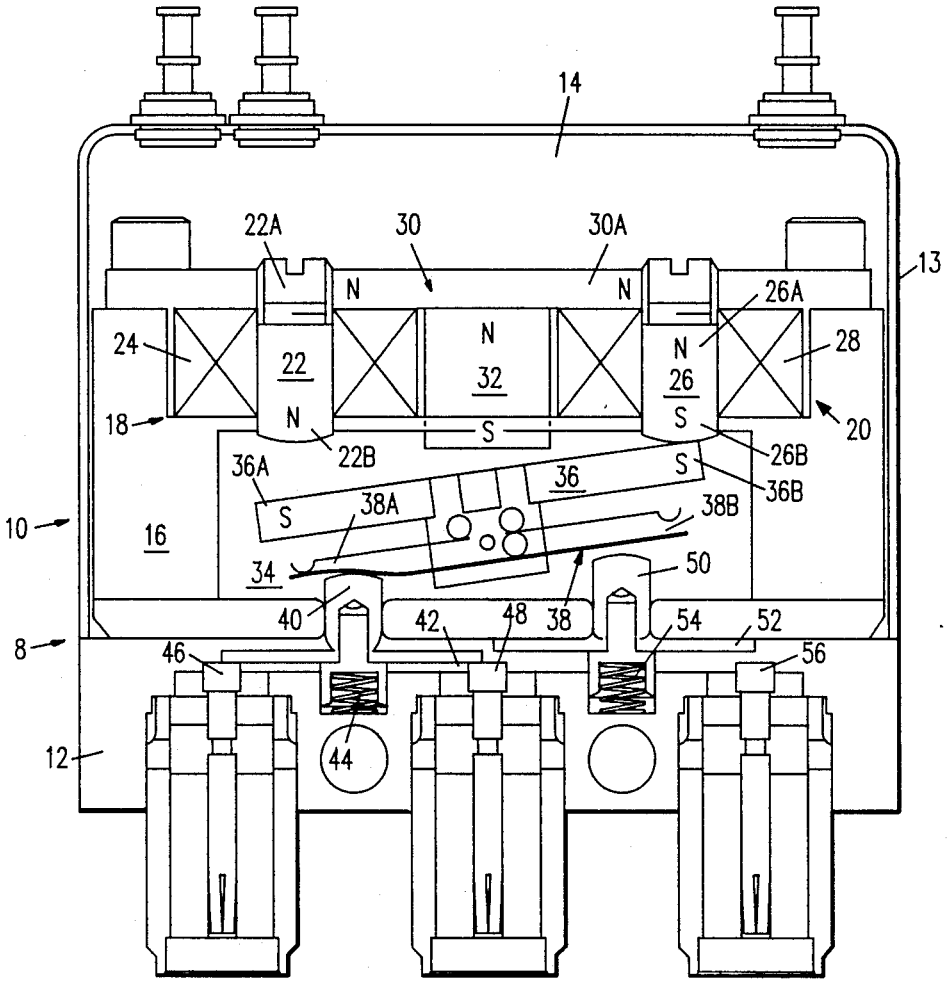
(PRIOR ART) FIG. 1
FIG. 1 is a sectional view of a typical prior art switching mechanism as described above.
Figure 2:
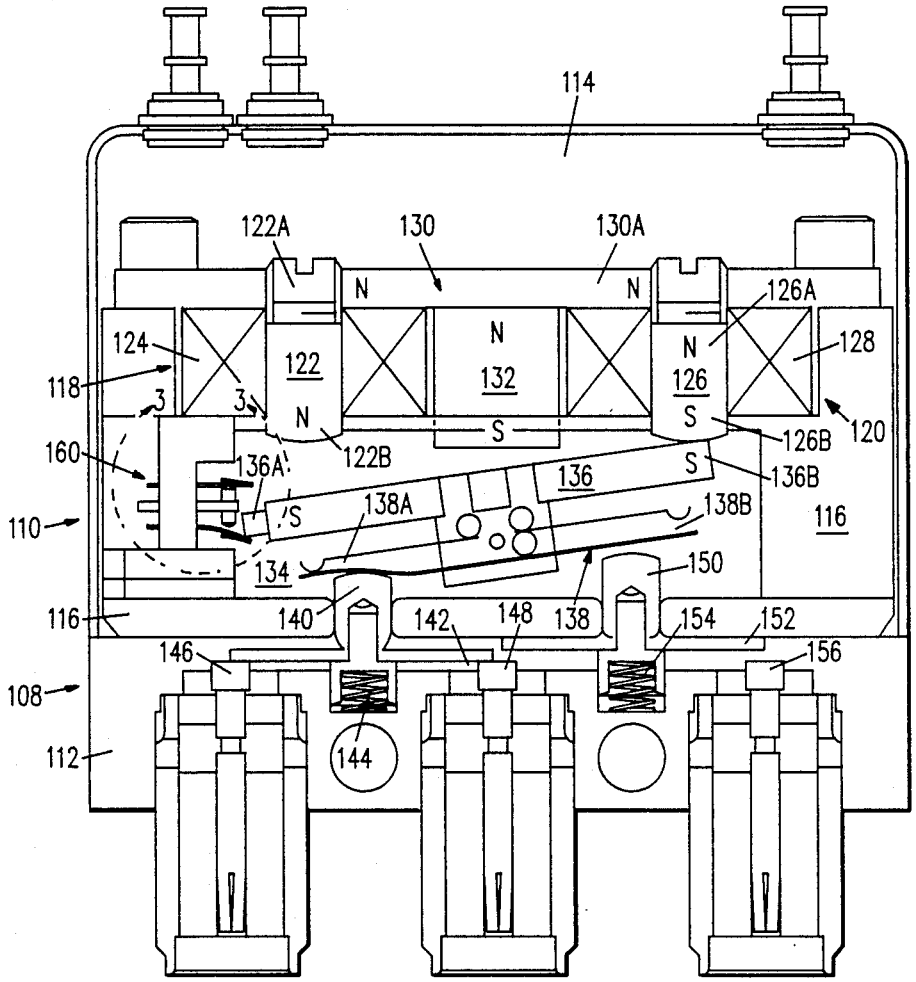
FIG. 2 is a sectional view of an embodiment of the present invention, showing the mechanical features thereof.

Shown in FIG. 2 is the present embodiment of the switching mechanism 108. The switching mechanism 108 is basically quite similar to that disclosed in FIG. 1, including a body 110 made up of body portions 112, 116, an iron plate 130, a permanent magnet 132 fixed to the iron plate 130 positioned between electromagnets 118, 120 including respective cores 122, 126 and coils 124, 128, and a rocker 136 pivotally mounted to the body portion 116, all as previously described.

Further included are dielectric rods 140, 150, conduction reeds 142 152 and springs 144, 154 operatively associated with the reeds 142, 152 and conductors 146, 148 again, all as previously described. Likewise included are spring mechanism portions 138A, 138B of spring mechanism 138 fixed to the rocker 136 for activation of the reeds 142, 152.

Figure 4:
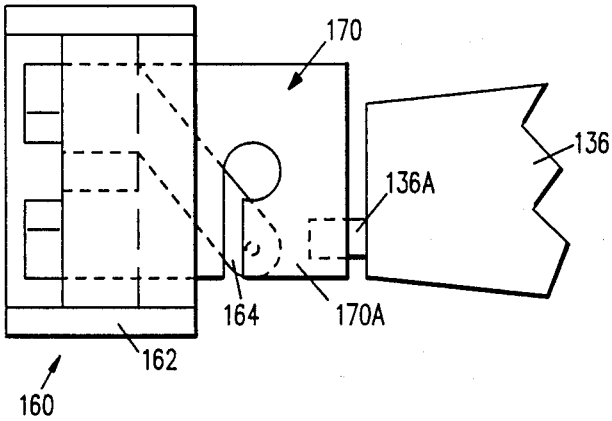
FIG. 4 is a plan view of the device of FIG. 3.
Figure 3:
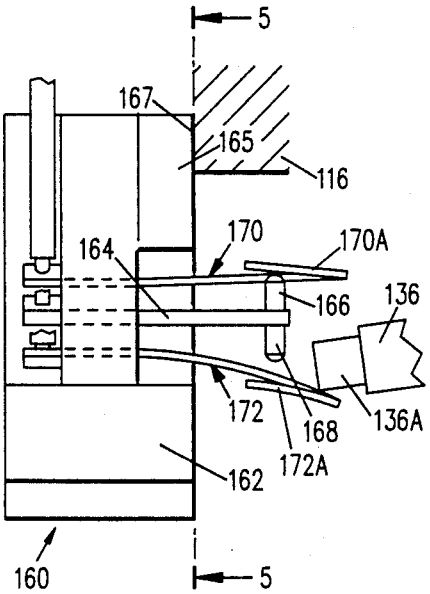
FIG. 3 is an enlarged view of the area 3—3 of FIG. 2, showing the rocker in its first position.
Figure 5:
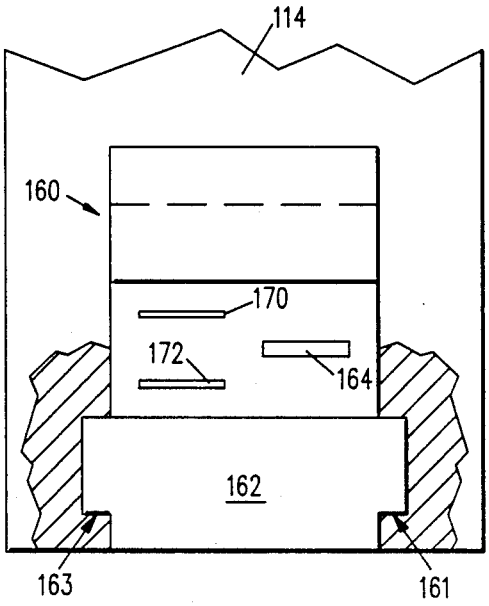
FIG. 5 is a sectional view taken along the line 5—5 of FIG. 3.

The rocker end portion 136A, which is a non-conductor (such as plastic) insert in the rocker 136, is operatively associated with a switch 160 which is shown in detail in FIGS. 3-5. The switch 160 includes a non-conductive base 162 which is mountable to the body portion 116 within an appropriate opening. The body portion 116 in fact defines recesses 161 into which extended portions 163 of the base 162 closely fit and slide, until another extended portion 165 of the base 162 is brought into contact with a face 167 defined by the body portion 116. This construction allows the simple positive location of the switch 160 relative to the body portion 116.

The base 162 has fixed to it a rigid conductive central switch portion 164 which has oppositely extending conductive legs 166, 168 affixed thereto adjacent its extended end. The switch 160 also includes conductive upper spring blade 170 and conductive lower spring blade 172 both fixed to base 162 and spaced from portion 164, and which include as respective parts thereof upper spring contact 170A and lower spring contact 172A. These spring blades 170, 172 are generally hooked shaped in configuration, with the upper and lower spring contacts 170A, 172A positioned generally adjacent the extended ends of these spring blades 170, 172 respectively. The configuration of the spring blades 170, 172 as generally hooked shaped allows for a long effective spring length as compared to, for example, spring blades which would extend straight from the base 162. This allows the use of less powerful (and less expensive) electromagnets 118, 120, and the requirement of less current therethrough in actuation.

Figure 6:
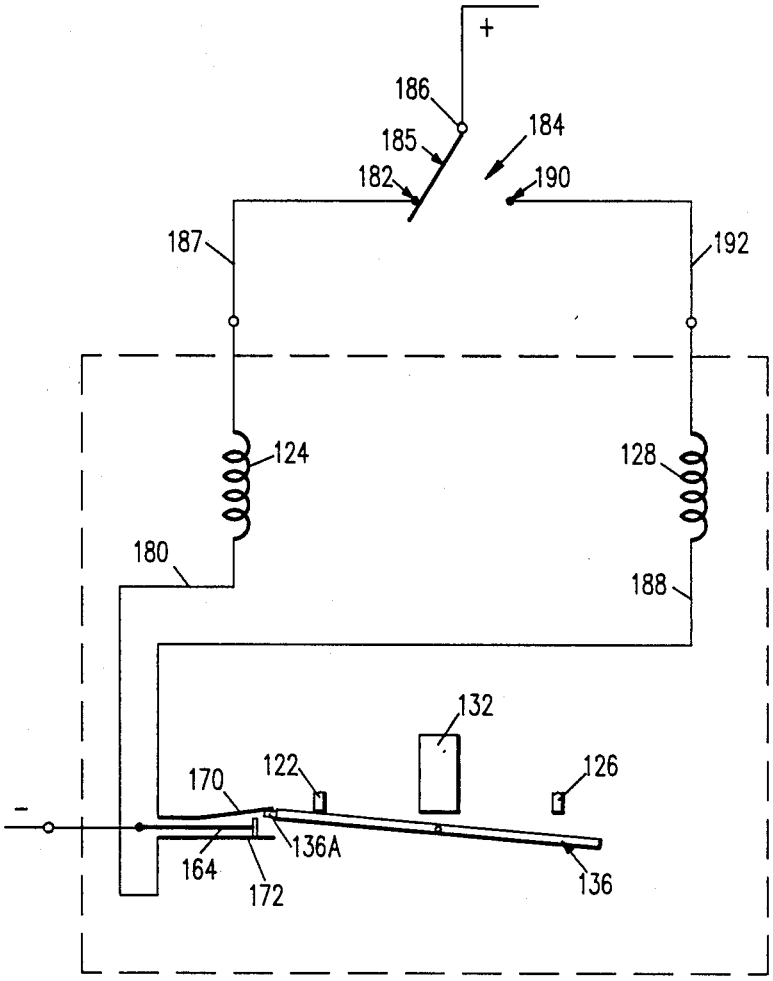
FIG. 6 is a schematic view of the circuitry of the present invention.

Referring to FIG. 6, the spring blade 172 connects with the coil 124 through a conductor 180, that coil 124 connecting through a conductor 187 to one terminal 182 of a two-way switch 184, the terminal 186 of which is connectible to a voltage supply, for example, a positive voltage supply. The switch portion 170 connects with the coil 128 through a conductor 188, the coil 128 in turn connecting with the terminal 190 of the switch 184 through a conductor 192. The switch portion 164 is connectible to another voltage supply, for example, a negative voltage supply.

With the switching mechanism in the state as shown in FIG. 2 and FIG. 3, assuming that it is desired that the state of the rocker 136 be changed from its first position shown therein to its second position, the switch 184 is activated to move the switch arm 185 to its rightward position (FIG. 6), providing current through the conductor 192, through the coil 128, through the conductor 188, and through the switch portion 170 and switch portion 164. In the meantime, of course, current is cut off from the coil 124. Upon the rocker 136 being moved sufficiently toward its second position in accordance with the operation described above, the spring portion 172 is allowed into contact with the leg 168, and as the rocker 136 approaches its second position, the spring portion 170 is moved out of contact with the leg 166, cutting off current from the coil 128. However, by proper configuration of the spring portions 170, 172, legs 166, 168, and rocker end portion 136A, it is ensured that this cutting off of current does not occur until the rocker 136 has moved sufficiently toward its second position to provide that it will in fact adopt its second position under the forces applied thereto as previously described. Meanwhile, of course, no current is being applied to the coil 128, because of the positioning of the switch arm 185. Thus, the rocker 136 has adopted its second position, and is secure therein, latched to the coil 126 by magnet 132, with no current passing through either of the coils 124, 128.

It will readily be seen that movement of the switch arm 185 to its other position, connecting terminal 186 with terminal 190, provides movement of the rocker 136 from its second to its first position, exactly the reverse of the situation just described, and again ending up with no current being applied to either of the coils 124, 128.

Thus, the objects of the invention cited above are met, and the switching mechanism operates in a highly efficient, effective manner, with only minimum current being applied to achieve switching of the device.

I claim:

1. In a switching mechanism having a body and first and second electromagnets mounted to the body, to each of which current can be applied and from each of which current can be cut off, and a movable member movably mounted to the body, movable to a first position determining a first switching mechanism state upon application of current to the first electromagnet, and movable to a second position determining a second switching mechanism state upon application of current to the second electromagnet, the improvement comprising means for providing that current is cut off from said first electromagnet upon the movable member being moved from its second position toward its first position sufficiently to determine that the movable member will adopt its first position, and for providing that current is cut off from the second electromagnet upon the movable member being moved from its first toward its second position sufficiently to determine that the movable member will adopt its second position, wherein the means for providing that current is cut off comprise a switch operatively associated with the first and second electromagnets and only a single portion of the movable member.

2. In a switching mechanism having a body and first and second electromagnets mounted to the body, to each of which current can be applied and from each of which current can be cut off, and a movable member movably mounted to the body, movable to a first position determining a first switching mechanism state upon application of current to the first electromagnet, and movable to a second position determining a second switching mechanism state upon application of current to the second electromagnet, the improvement comprising means for providing that current is cut off from said first electromagnet upon the movable member being moved from its second position toward its first position sufficiently to determine that the movable member will adopt its first position, and for providing that current is cut off from the second electromagnet upon the movable member being moved from its first toward its second position sufficiently to determine that the movable member will adopt its second position, wherein the means for providing that current is cut off comprise a switch operatively associated with the first and second electromagnets and a portion of the movable member, wherein said switch comprises a first switch portion connectable to a first voltage supply, a second switch portion movable relative to said first switch portion, and a third switch portion movable relative to said first switch portion, the first switch portion being positioned generally between the second and third switch portions, the portion of the movable member being in contact with and moving the second switch portion away from contact with the first switch portion with the movable member in its first position, the third switch portion being in contact with the first switch portion with the movable member in its first position, the portion of the movable member being in contact with and moving the third switch portion away from contact with the first switch portion with the movable member in its second position, the second switch portion being in contact with the first switch portion with the movable member in its second position, the second switch portion being connected to the first electromagnet, the third switch portion being connected to the second electromagnet, the first and second electromagnets being connectable to a second voltage supply.

3. The switching mechanism of claim 2 wherein the second and third switch portions are spring portions.

4. The switching mechanism of claim 3 wherein the portion of the movable member is positioned generally between the spring portions of the switch.

5. The switching mechanism of claim 4 wherein each spring portion of the switch is generally hook shaped in configuration, with the portion of the movable member adjacent the extended end of each such spring portion.

6. The switching mechanism of claim 5 wherein the movable member comprises a rocker pivotably mounted to the body.

7. The switching mechanism of claim 2 wherein the portion of the movable member is positioned generally between the second and third portions of the switch.

8. The switching mechanism of claim 7 wherein the movable member comprises a rocker pivotably mounted to the body.

9. The switching mechanism of claim 7 wherein the portion of the movable member is of insulating material.

10. In a switching mechanism having a body and first and second electromagnets mounted to the body, to each of which current can be applied and from each of which current can be cut off, and a movable member movably mounted to the body, movable to a first position determining a first switching mechanism state upon application of current through the first electromagnet, and movable to a second position determining a second switching mechanism state upon application of current through the second electromagnet, the improvement comprising means for providing that current is cut off from said first electromagnet upon the movable member being moved from its second position toward its first position sufficiently to determine that the movable member will adopt its first position, and for providing that current is cut off from the second electromagnet upon the movable member being moved from its first toward its second position sufficiently to determine that the movable member will adopt its second position, wherein the means for providing that current is cut off comprise a switch operatively associated with the first and second electromagnets and a portion of the movable member, and further comprising means for positively locating the switch to the body comprising a switch base on which the switch means are fixed, said switch base being mountable to the body by means of an extended portion and a recess operatively associating the base and body allowing sliding of the base relative to the body.

11. The switching mechanism of claim 10 wherein the means for positively locating the switch to the body further comprise respective surfaces of the base and body which may be brought into contact upon sliding of the base relative to the body.

* * * * *